US006052096A

United States Patent [19]

Tsuru et al.

[11] Patent Number: 6,052,096

[45] **Date of Patent: *Apr. 18, 2000**

[54] CHIP ANTENNA

[75] Inventors: Teruhisa Tsuru, Kameoka; Harufumi Mandai, Takatsuki; Koji Shiroki; Kenji Asakura, both of Shiga-ken; Seiji Kanba, Otsu, all of Japan

[73] Assignee: Murata Manufacturing Co., Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/693,447

[22] Filed: Aug. 7, 1996

[30] Foreign Application Priority Data

Aug. 7, 1995 [JP] Japan ..... 7-201153

[51] Int. Cl.[7] ..... H01Q 1/38

[52] U.S. Cl. ..... 343/787; 343/873; 343/895

[58] Field of Search ..... 343/895, 873, 343/700 MS, 787, 788, 702; H01Q 1/36, 1/38, 1/40

[56] References Cited

U.S. PATENT DOCUMENTS

| | | | |
|---|---|---|---|
| 4,246,586 | 1/1981 | Henderson et al. | 343/873 |
| 4,644,366 | 2/1987 | Scholz | 343/702 |
| 5,155,493 | 10/1992 | Thursby et al. | 343/873 |
| 5,262,791 | 11/1993 | Tsuda et al. | 343/700 MS |
| 5,528,254 | 6/1996 | Howng et al. | 343/873 |
| 5,541,610 | 7/1996 | Imanish et al. | 343/702 |
| 5,581,262 | 12/1996 | Kawahata et al. | 343/873 |

FOREIGN PATENT DOCUMENTS

| | | |
|---|---|---|
| 706231 | 4/1996 | European Pat. Off. . |
| 93 00721 | 1/1993 | WIPO . |

OTHER PUBLICATIONS

*Patent Abstracts of Japan,* vol. 008, No. 099 (E–243) May 10, 1984, JP–A–59 017705, Jan. 30, 1984.

*Patent Abstracts of Japan,* vol. 018, No. 311 (E–1561) Jun. 14, 1994, JP–A–06 069057, Mar. 11, 1994.

Parfitt, A.J., et al., "Analysis of Infinite Arrays of Substrate–Supported Metal Strip Antennas", *IEEE Transactions of Antennas and Propagation,* Feb. 1993, USA, vol. 41, No. 2, pp. 191–199.

Parfitt, A.J., et al., "On the Modeling of Metal Strip Antennas Contiguous with the Edge of Electrically Thick Finite Size Dielectric Substrates", *IEEE Transactions on Antennas and Propagation*, Feb. 1992, USA, vol. 40, No. 2, pp. 134–140.

Ghosh, S.K., et al., Mircrostrip Antenna on Ferrimagnetic Substrates in the Very High Frequency Range, Proceedings of Tencon 87: 1987 IEEE Region 1–3, 5, 10 Conference 'Computers and Communications Technology Toward 2000', Aug. 1987, USA, vol. 3, pp. 1337–1341.

Grady, J.P., et al., "Printed Circuit Manufacturing Technology Applied to Microstrip/Stripline Antennas", Northcon/84. Mini/Micro Northwest–84. Conference Record, Oct. 1984, USA, pp. 10/3/1–9.

*Primary Examiner*—Michael C. Wimer
*Attorney, Agent, or Firm*—Ostrolenk, Faber, Gerb & Soffen, LLP

[57] ABSTRACT

The present invention is directed to provide a compact chip antenna for mobile communication comprising a base member which comprises either of a material having a dielectric constant $\epsilon$ of $1<\epsilon<130$ or a material having a relative permeability $\mu$ of $1<\mu<7$, at least one conductor formed on the surface of the base member and/or inside the base member, and at least one feeding terminal provided on the surface of the substrate for applying a voltage to the conductor. The conductor comprises a metal mainly containing any one of copper, nickel, silver, palladium, platinum, or gold.

12 Claims, 2 Drawing Sheets

CHIP ANTENNA

BACKGROUND OF THE INVENTION

1. Field of the Invention

The present invention relates to chip antennas. In particular, the present invention relates to a chip antenna used for mobile communication and local area networks (LAN).

2. Description of the Related Art

FIG. 3 shows a prior art monopole antenna 50. The monopole antenna 50 has a conductor 51, one end 52 of the conductor 51 being a feeding point and the other end 53 being a free end in the air (dielectric constant $\epsilon$=1 and relative permeability $\mu$=1).

Because the conductor of the antenna is present in the air in linear antennas, such as the prior monopole antenna 50, the size of the antenna conductor must be relatively large. For example, when the wavelength in the vacuum is $\lambda$ in the monopole antenna 50, the length of the conductor 51 must be $\lambda_0/4$. Thus, such an antenna cannot be readily used for mobile communication or other application which require a compact antenna.

SUMMARY OF THE INVENTION

It is an object of the present invention to provide a compact chip antenna which can be used for mobile communication.

In accordance with the present invention, a chip antenna comprises a base member which comprises either a material having a dielectric constant $\epsilon$ of $1<\epsilon<130$ or a material having a relative permeability $\mu$ of $1<\mu<7$, at least one conductor connected to the base member by being formed on the surface of the base member and/or inside the base member, and at least one feeding terminal provided on the surface of the substrate for applying a voltage to the conductor.

The conductor comprises a metal mainly containing any one of copper, nickel, silver, palladium, platinum, or gold.

The chip antenna in accordance with an embodiment of the present invention has a wavelength shortening effect because the base member is formed of either a material having a dielectric constant $\epsilon$ of $1<\epsilon<130$ or a material having a relative permeability $\mu$ of $1<\mu<7$.

Further, the chip antenna in accordance with another embodiment of the present invention enables monolithic sintering of the conductive pattern composed of a base member and a conductor, because the conductive pattern is formed of a metal mainly containing any one of copper(Cu), nickel (Ni), silver (Ag), palladium (Pd), platinum (Pt), or gold (Ag).

Other features and advantages of the present invention will become apparent from the following description of the invention which refers to the accompanying drawings.

DETAILED DESCRIPTION OF EMBODIMENTS OF THE INVENTION

Figure 1:
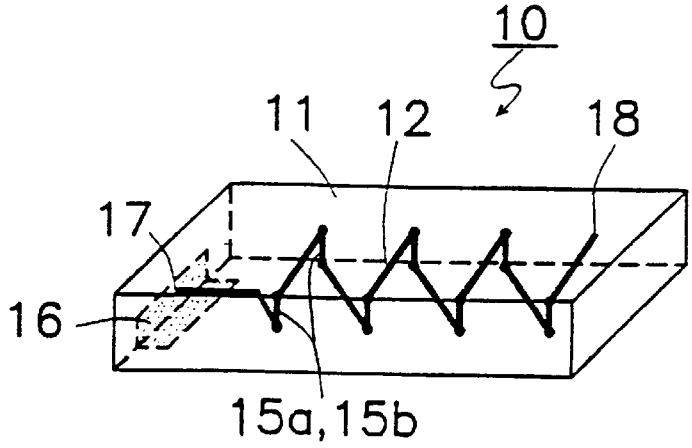
FIG. 1 is an isometric view illustrating an embodiment of a chip antenna in accordance with the present invention.
Figure 2:
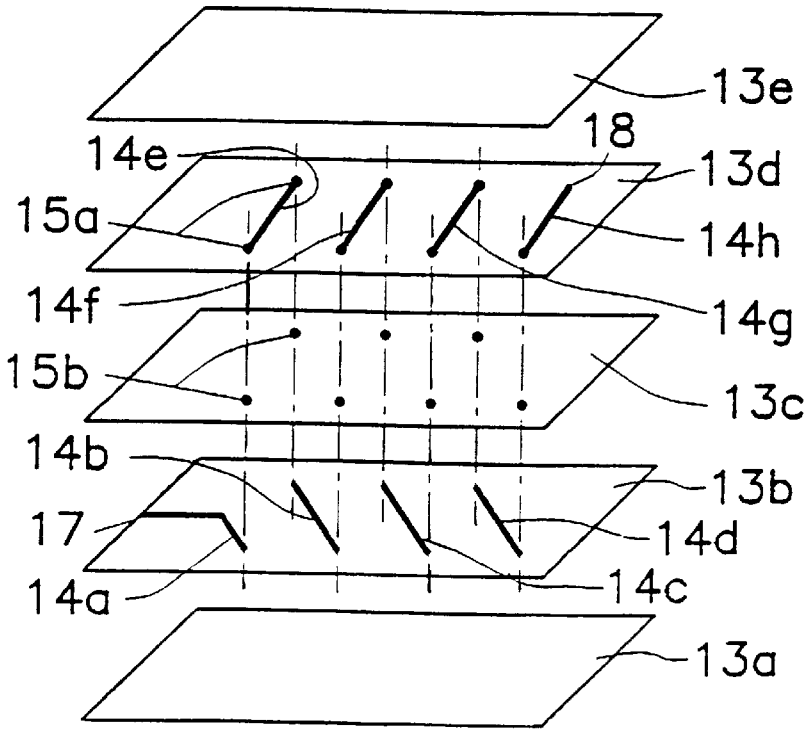
FIG. 2 is an exploded isometric view of FIG. 1.
Figure 3:
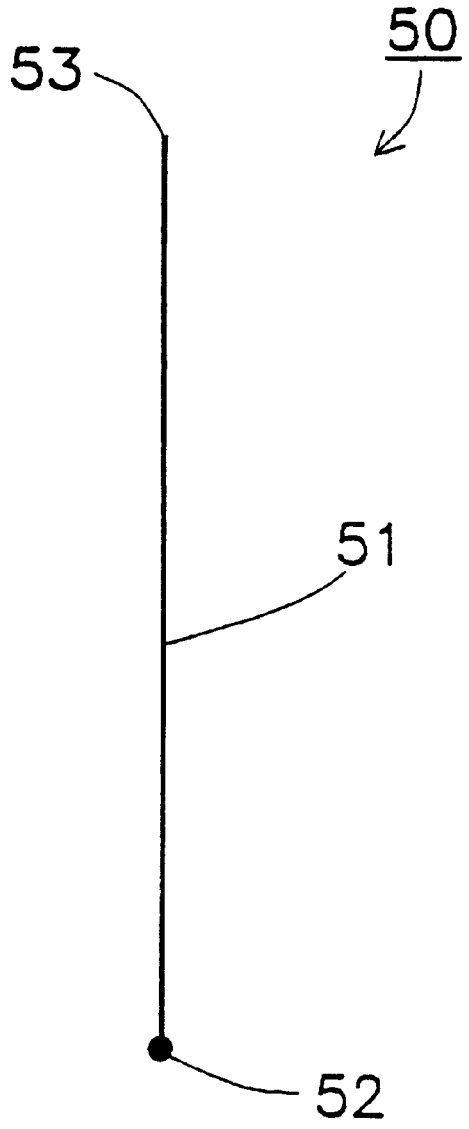
FIG. 3 PRIOR ART
FIG. 3 is a prior art monopole antenna.

FIGS. 1 and 2 are an isometric view and an exploded isometric view illustrating an embodiment of a chip antenna 10 in accordance with the present invention.

The chip antenna 10 comprises a conductor 12 which is spiralled along the longitudinal direction in a rectangular dielectric base member 11. The dielectric base member is formed by laminating rectangular sheets 13*a*–13*e*, each having a dielectric constant of 2 to 130, or having a relative permeability of 2 to 7, as shown in Tables 1 and 2.

TABLE 1

| No. | Composition | Dielectric Constant | Q · f |
|---|---|---|---|
| 1 | Bi-Pb-Ba-Sm-Ti-O | 130 | 1,000 |
| 2 | Bi-Pb-Ba-Nd-Ti-O | 110 | 2,500 |
| 3 | Pb-Ba-Nd-Ti-O | 90 | 5,000 |
| 4 | Ba-Nd-Ti-O | 60 | 4,000 |
| 5 | Nd-Ti-O | 37 | 8,000 |
| 6 | Mg-Ca-Ti-O | 21 | 20,000 |
| 7 | Mg-Si-O | 10 | 80,000 |
| 8 | Bi-Al-Si-O | 6 | 2,000 |
| 9 | (Ba-Al-Si-O) + Teflon ® Polytetrafluoroethylene Resin | 4 | 4,000 |
| 10 | Teflon ® Polytetrafluoroethylene Resin | 2 | 10,000 |

TABLE 2

| No. | Composition | Relative Permeability | Threshold Frequency |
|---|---|---|---|
| 11 | Ni/Co/Fe/O = 0.49/0.04/0.94/4.00 | 7 | 130 MHz |
| 12 | Ni/Co/Fe/O + 0.47/0.06/0.94/4.00 | 5 | 360 MHz |
| 13 | Ni/Co/Fe/O + 0.45/0.08/0.94/4.00 | 4 | 410 MHz |
| 14 | (Ni/Co/Fe/O + 0.45/0.08/0.94/4.00) + Teflon | 2 | 900 MHz |

In Tables 1 and 2, the sample having a dielectric constant of 1 and a relative permeability of 1 is not selected because the sample is identical to the prior art antenna.

The Q·f in Table 1 represents the product of the Q value and a measuring frequency and is a function of the material. The threshold frequency in Table 2 represents the frequency that the Q value is reduced by half to an almost constant Q value at a low frequency region, and represents the upper limit of the frequency applicable to the material.

At the surface of the sheet layers 13*b* and 13*d* of the sheet layers 13*a* through 13*e*, each of which has a dielectric constant $\epsilon$ of $1<\epsilon<130$ or a relative permeability $\mu$of $1<\mu<7$, linear conductive patterns 14*a* through 14*h* comprising a metal mainly containing Cu, Ni, Ag, Pd, Pt or Au are provided by printing, evaporating, laminating or plating, as shown in Table 3. In the sheet layer 13*d*, a via hole 15*a* is formed at both ends of the conductive patterns 14*e* through 14*g* and one end of the conductive pattern 14*h*. Further, in the sheet layer 13*c*, a via hole 15*b* is provided at the position corresponding to the via hole 15*a*, in other words, at one end of the conductive pattern 14*a* and at both ends of the conductive patterns 14*b* through 14*d*. A spiral conductor 12 having a rectangular cross-section is formed by laminating the sheet layers 13*a* through 13*e* so that the conductive patterns 14*a* through 14*h* come in contact with via holes 15*a*, 15*b*. In material Nos. 1 to 8 and Nos. 11 to 13, the chip antenna 10 is made by monolithically sintering the base member 11 and the conductive patterns 14*a* through 14*h* under the conditions shown in Table 3. On the other hand, such a sintering process is not employed in material Nos. 9, 10 and 14 each containing a resin.

TABLE 3

| Metal | Material No. | Sintering Atmosphere | Sintering Temperature |
|---|---|---|---|
| Cu | 8 | Reductive | <1,000° C. |
| Ni | 7 | Reductive | 1,000 to 1,200° C. |
| Ag-Pd alloy | 1,2,3,4,5,11,12 | Air | 1,000 to 1,250° C. |
| Pt | 6 | Air | <1,250° C. |
| Ag | 9,11,14 | Not Sintered | |

Each material No. in Table 3 is identical to that in Tables 1 and 2.

One end of the conductor 12, i.e., the other end of the conductive pattern 14*a*, is brought to the surface of the dielectric base member 11 to form a feeding end 17 which connects to a feeding terminal 16 for applying a voltage to the conductor 12, and the other end, i.e., the other end of the conductive pattern 14*h*, forms a free end 18 in the dielectric base member 11.

Table 4 shows relative bandwidth at the resonance point of the chip antenna 10 when using various materials as the sheet layers 13*a* through 13*e* comprising the base member 11. The relative bandwidth is determined by the equation: relative bandwidth [%]=(bandwidth [GHz]/center frequency [GHz])100. The chip antennas 10 for 0.24 GHz and 0.82 GHz are prepared by adjusting the turn numbers and length of the conductor 12.

TABLE 4

| | Relative Bandwidth | |
|---|---|---|
| Material No. | 0.24 GHz | 0.82 GHz |
| 1 | Not measurable | Not measurable |
| 2 | 1.1 | 1.0 |
| 3 | 1.7 | 1.5 |
| 4 | 2.4 | 2.3 |
| 5 | 2.9 | 2.7 |
| 6 | 3.1 | 3.0 |
| 7 | 3.5 | 3.3 |
| 8 | 3.8 | 3.4 |
| 9 | 4.1 | 3.7 |
| 10 | 4.5 | 4.3 |
| 11 | Not measurable | Not measurable |
| 12 | 2.5 | 2.4 |
| 13 | 3.0 | 2.7 |
| 14 | 3.2 | 3.0 |

Each material No. in Table 4 is identical to that in Tables 1 and 2. In Table 4, Not Measurable means a relative bandwidth of 0.5 [%] or less, or a too small resonance to measure.

Results in Table 4 demonstrate that chip antennas using a material having a dielectric constant of 130 (No. 1 in Table 1) and a material having a relative permeability of 7 (No. 11 in Table 2) do not exhibit antenna characteristics, as shown as "Not Measurable". On the other hand, when the dielectric constant is 1 or the relative permeability is 1, no compact chip antenna is achieved by the wavelength shortening effect due to the same value as the air. Thus, suitable materials have a dielectric constant $\epsilon$ of $1<\epsilon<130$, or a relative permeability $\mu$ of $1<\mu<7$.

At a resonance frequency of 0.82 GHz, the size of the chip antenna 10 is 5 mm wide, 8 mm deep, and 2.5 mm high, and approximately one-tenth of the size of the monopole antenna 50, approximately 90 mm.

In the embodiment set forth above, the size of the chip antenna can be reduced to approximately one-tenth of the prior art monopole antenna while satisfying antenna characteristics, by using a material of 1<dielectric constant<130 or 1<relative permeability<7. Thus, a compact antenna with sufficiently satisfactory antenna characteristics can be prepared. Further, since the conductive pattern composed of the base member and conductor can be monolithically sintered, the production process can be simplified and cost reduction can be achieved.

In the embodiment set forth above, several materials are used as examples, but the embodiment is not to be limited thereto.

Further, although the embodiment set forth above illustrates an antenna having one conductor, two or more conductors may be available.

Moreover, although the embodiment set forth above illustrates a conductor formed inside the base member, the conductor may be formed by coiling the conductive patterns on the surface of the base member and/or inside the base member. Alternatively, a conductor may be formed by forming a spiral groove on the surface of the base member and coiling a wire material, such as a plated wire or enamelled wire, along the groove, or a conductor may be meanderingly formed on the surface of the base member and/or inside the base member.

The feeding terminal is essential for the practice of the embodiment in accordance with the present invention.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A chip antenna, comprising:

a first generally planar sheet having a plurality of spaced, first conductors formed on one major surface thereof, a second generally planar sheet having a plurality of spaced second conductors formed on one major surface thereof;

at least one generally planar additional sheet located between said first and second generally planar sheets;

said first, second and at least one generally planar additional sheet being laminated together to form an elongated structure wherein respective pairs of first and second conductors are coupled to one another through said at least one generally planar additional sheet to form respective spiral loops of a spiral antenna so that a central axis of said spiral antenna extends generally parallel to a longitudinal direction of said elongated structure;

each of said sheets being formed of a material having a permeability of 1<u<7; and a feeding terminal coupled to one end of said spiral antenna so that said chip antenna forms a mono-pole antenna.

2. The antenna of claim 1, wherein said spaced conductors formed on said first sheet extend generally parallel to one another and said spaced conductors formed on said second sheet extend generally parallel to one another.

3. The antenna of claim 2, wherein said spaced conductors formed on said first sheet extend at an acute angle with respect to said spaced conductors formed on said second sheet.

4. The antenna of claim 3, wherein said sheets are generally rectangular in shape as viewed along the major surfaces thereof and wherein said elongated structure is generally in the shape of a rectangular parallel-piped.

5. The antenna of claim 4, wherein each of said sheets is formed of material having a dielectric constant $\epsilon$ of $1<\epsilon<130$.

6. The antenna of claim 1, wherein each of said sheets is formed of material having a dielectric constant $\epsilon$ of $1<\epsilon<130$.

7. The antenna of claim 1, wherein said conductors consist essentially of copper, nickel, silver palladium, platinum, gold or a sliver palladium alloy.

8. The antenna of claim 1, wherein said one major surface of said first planar sheet faces away from said one major surface of said second planar sheet.

9. The antenna of claim 1, wherein each of said sheets is composed of a material selected from the group consisting of Bc—Pb—Ba—Nd—Ti, Pb—Ba—Nd—Ti-0, Ba—Nd—Ti—O, Nd—Ti-0, Mg—Ca—Ti-0, Mg—Si-0, Bc—Al—Si-0, (Ba—Al—Si-0)+polytetrafluoroethylene resin, and polytetrafluoroethylene resin.

10. The antenna of claim 1, wherein said respective pairs of first and second conductors are coupled together by respective conductors extending through via holes located in said sheets.

11. The antenna of claim 1, wherein said feeding terminal extends to an outer surface of said elongated structure.

12. The antenna of claim 1, wherein there are no conductors formed on the major surfaces of said at least one generally planar additional sheet.

* * * * *